US010659857B1

(12) United States Patent
Hu et al.

(10) Patent No.: US 10,659,857 B1
(45) Date of Patent: May 19, 2020

(54) RAPIDLY MOUNTABLE CEILING LOUDSPEAKER DEVICE

(71) Applicant: Huizhou Chuangxiang Audio Products Co., Ltd., Huizhou (CN)

(72) Inventors: Hailin Hu, Huizhou (CN); Meng Liu, Huizhou (CN); Ankang Liu, Huizhou (CN); Tianyun Wu, Huizhou (CN)

(73) Assignee: Huizhou Chuangxiang Audio Products Co., Ltd., Huizhou (CN)

( * ) Notice: Subject to any disclaimer, the term of this patent is extended or adjusted under 35 U.S.C. 154(b) by 0 days.

(21) Appl. No.: 16/389,241

(22) Filed: Apr. 19, 2019

(30) Foreign Application Priority Data

Nov. 30, 2018 (CN) ..... 2018 2 2011277 U

(51) Int. Cl.
*H04R 1/00* (2006.01)
*H04R 1/02* (2006.01)

(52) U.S. Cl.
CPC ..... *H04R 1/025* (2013.01); *H04R 2201/021* (2013.01)

(58) Field of Classification Search
CPC ..... H04R 1/025; H04R 2201/021
See application file for complete search history.

(56) References Cited

U.S. PATENT DOCUMENTS 6,398,179 B1 * 6/2002 Soles ..... B60G 11/28 248/222.51
7,298,863 B2 * 11/2007 Kirihara ..... B60R 11/0217 381/302
7,780,135 B2 * 8/2010 Nelson ..... H04R 1/025 248/342
9,479,852 B2 * 10/2016 Yang ..... H04R 1/025
9,729,952 B2 * 8/2017 Ivey ..... F16M 13/027
9,774,937 B2 * 9/2017 Shiojima ..... H04R 1/026
9,843,849 B1 * 12/2017 Lasnier de Lavalette ..... H04R 1/025
9,860,630 B2 * 1/2018 Strange ..... H04R 1/026
9,877,095 B2 * 1/2018 Suzuki ..... H04R 1/023
10,154,338 B2 * 12/2018 Strange ..... H04R 1/26
2004/0179710 A1 * 9/2004 Farinelli, Jr. ..... H04R 1/025 381/386
2006/0177088 A1 * 8/2006 Howard ..... H04R 1/023 381/391
2007/0098204 A1 * 5/2007 Iekura ..... H04R 1/025 381/386
2007/0121988 A1 * 5/2007 Merrey ..... H04R 1/025 381/386
2008/0308705 A1 * 12/2008 Sharp ..... H04R 1/02 248/544

(Continued)

*Primary Examiner* — Matthew A Eason
(74) *Attorney, Agent, or Firm* — Muncy, Geissler, Olds & Lowe, P.C.

(57) ABSTRACT

The invention discloses a rapidly mountable ceiling loudspeaker device comprising a loudspeaker housing, a ceiling locking assembly, a woofer module and a dustproof assembly. The loudspeaker housing comprises a basket, a speaker inner frame and a surface frame ring body; the ceiling locking assembly comprises a locking sleeve body, a ceiling locking piece and a locking member; the woofer module is arranged in the basket; and the dustproof assembly is arranged on the speaker inner frame. After the scheme is employed, the ceiling loudspeaker device can be efficiently assembled and disassembled without the aid of a mounting tool.

10 Claims, 4 Drawing Sheets

(56) References Cited

U.S. PATENT DOCUMENTS

| | | | | |
|---|---|---|---|---|
| 2010/0040254 | A1* | 2/2010 | Wright | H04R 1/02<br>381/395 |
| 2011/0017889 | A1* | 1/2011 | Nelson | B60R 11/0217<br>248/229.23 |
| 2018/0295432 | A1* | 10/2018 | Humphreys | H04R 1/026 |

* cited by examiner

RAPIDLY MOUNTABLE CEILING LOUDSPEAKER DEVICE

FIELD OF THE INVENTION

The invention relates to the technical field of loudspeaker devices, and particularly to a rapidly mountable ceiling loudspeaker device.

BACKGROUND OF THE INVENTION

At present, a loudspeaker device is also known as a "speaker". The loudspeaker device is a very common electroacoustic transducing device, which can be seen in sounding electrical and electronic equipment. The loudspeaker device is a transducing device that converts an electrical signal into an acoustic signal. The performance of the loudspeaker device has a great influence on sound quality. The loudspeaker device is one of the weakest devices in audio equipment, but is also one of the most important components for sound effects. There are a variety of loudspeaker devices and their price varies greatly. Under an electromagnetic, piezoelectric or electrostatic effect, audio electrical energy allows a cone diaphragm or diaphragm to vibrate and resonate with the surrounding air to produce sound. A low-grade plastic sound box has a thin box body and cannot overcome resonance, and therefore has no sound quality; and the sound quality of a wooden sound box is generally better than that of the plastic sound box due to a decrease in sound coloration caused by the resonance of the box body. A multimedia sound box is generally designed as being dual-unit and two-way, wherein one smaller loudspeaker device is responsible for the output of medium/high-pitched sound while the other larger loudspeaker device is responsible for the output of mid-bass sound. The selection of a sound box should be based on the materials of the two speakers: a treble unit of a multimedia active sound box is currently mainly made of a soft dome, which can cooperate with a digital sound source to reduce the stiffness of a high-frequency signal, thus providing a gentle, smooth and fine feeling. Multimedia sound boxes are now mainly made of soft domes such as silk films with better quality and PV films with lower cost.

For the existing loudspeaker devices, especially the loudspeaker devices mounted on the ceilings, most of the loudspeaker devices are screwed, i.e. the loudspeaker devices are fixed on the ceiling by screw locking members. Although the loudspeaker devices can be well mounted on the ceiling by means of screwing, there are many defects: firstly, for the way of screwing, with the passage of time, the screw locking members may have a reduced locking force on the loudspeaker devices due to rustiness, and if the screw locking members are loose, the loudspeaker devices are very likely to directly fall from the ceiling, which will endanger the personal safety of users; and secondly, for the way of screwing, a mounting tool such as a screwdriver is needed to for mounting, which significantly reduces the mounting efficiency of the loudspeaker devices by users, and greatly reduces the disassembly efficiency when the loudspeaker devices need to be maintained later.

SUMMARY OF THE INVENTION

An object of the invention is to overcome the disadvantages of the prior art, and to provide a rapidly mountable ceiling loudspeaker device which can be ensured with long-term stability, prevented from falling from the ceiling, and efficiently disassembled and assembled without the aid of a mounting tool.

The object of the invention is achieved by the following technical solutions.

A rapidly mountable ceiling loudspeaker device comprises:

a loudspeaker housing comprising a basket, a speaker inner frame and a surface frame ring body, wherein the basket is connected with the speaker inner frame, the surface frame ring body is arranged between the basket and the speaker inner frame, the speaker inner frame can be rotated in the surface frame ring body around the surface frame ring body as a rotation axis, and the surface frame ring body is provided with a via hole and provided with a guide piece at an edge of the via hole;

a ceiling locking assembly comprising a locking sleeve body, a ceiling locking piece and a locking member, wherein the locking sleeve body is arranged on the basket and provided with a locking hole, the ceiling locking piece is provided with a through hole, an end of the locking member is passed through the through hole and screwed into the locking hole, the ceiling locking piece is provided with a ceiling locking portion, and the ceiling locking portion can move in a direction towards or away from the via hole upon the rotation of the speaker inner frame;

a woofer module arranged in the basket; and a dustproof assembly arranged on the speaker inner frame.

In one embodiment, the speaker inner frame is provided with a limiting column, the limiting column is provided with a dome portion, the surface frame ring body comprises a ring wall and a limiting ring body, the limiting ring body is arranged on an inner wall of the ring wall, the limiting ring body is arranged between the basket and the speaker inner frame, the ceiling locking portion is located directly above the limiting ring body, the limiting ring body is provided with a sliding groove, the dome portion is slidably arranged in the sliding groove, and the via hole is located on the ring wall.

In one embodiment, the ring wall and the limiting ring body are integrally formed structures.

In one embodiment, the woofer module comprises a bass iron core, a bass magnet, a bass washer, a bass voice coil and a cone paper, wherein the bass magnet is arranged on the bass iron core, the bass washer is arranged on the bass magnet, the basket is connected with the bass washer, the bass iron core, the bass magnet and the bass washer together enclose a bass magnetic path gap, the bass voice coil is located in the bass magnetic path gap and connected with an inner edge of the cone paper, and an outer edge of the cone paper is connected with the basket.

In one embodiment, the woofer module further comprises a damper, an inner edge of which is connected with the bass voice coil and an outer edge of which is connected with the basket.

In one embodiment, the woofer module further comprises a dust cap which is connected with the inner edge of the cone paper.

In one embodiment, the rapidly mountable ceiling loudspeaker device further comprises a tweeter module which is arranged in the speaker inner frame.

In one embodiment, the tweeter module comprises a treble housing, a treble iron core, a treble magnet, a treble washer, a treble voice coil and a diaphragm, wherein the treble housing is arranged in the speaker inner frame, the treble iron core is arranged in the treble housing, the treble magnet is arranged on the treble iron core, the treble washer is arranged on the treble magnet, the treble iron core, the treble magnet and the treble washer together enclose a treble magnetic path gap, the treble voice coil is located in the treble magnetic path gap and connected with the diaphragm, and an outer edge of the diaphragm is connected with the treble housing.

In one embodiment, the treble iron core has a "U"-shaped cross section.

In one embodiment, the treble magnet has a rectangular cross section.

Compared with the prior art, the invention has the following advantages and beneficial effects:

The rapidly mountable ceiling loudspeaker device of the invention is provided with a loudspeaker housing, a ceiling locking assembly, a woofer module and a dustproof assembly. In the practical application process, when a user rotates the speaker inner frame clockwise, the ceiling locking portion moves in a direction towards the via hole, and after the ceiling locking portion is passed through the via hole, the ceiling locking portion is abutted against the ceiling and the ceiling loudspeaker device is mounted on the ceiling; and when the user rotates the speaker inner frame counterclockwise, the ceiling locking portion moves in a direction away from the via hole, and the ceiling locking portion is disengaged from the via hole and no longer abutted against the ceiling to complete the disassembly of the ceiling loudspeaker device, thus achieving the rapid mounting and disassembly of the ceiling loudspeaker device. The ceiling loudspeaker device can be efficiently assembled and disassembled without the aid of a mounting tool, and the long-term mounting stability of the ceiling loudspeaker device can be ensured, thus preventing the ceiling loudspeaker device from falling from the ceiling and endangering the personal safety of the user.

BRIEF DESCRIPTION OF THE DRAWINGS

In order to illustrate the technical solutions of the embodiments of the invention more clearly, the accompanying drawings to be used in the embodiments will be simply introduced below. It should be understood that the following accompanying drawings show only certain embodiments of the invention and therefore cannot be regarded as limiting the scope, and the ordinary persons skilled in the art can also obtain other relevant accompanying drawings based on these accompanying drawings without inventive work.

DETAILED DESCRIPTION OF THE INVENTION

In order to facilitate the understanding of the invention, the invention will be described more fully hereinafter with reference to relevant accompanying drawings.

Preferred embodiments of the invention are shown in the accompanying drawings. However, the invention may be implemented in many different forms and is not limited to the embodiments described herein. Rather, these embodiments are provided so that the disclosure of the invention will be more thoroughly and fully understood. It should be noted that when an element is referred to as being "fixed" to another element, the element may be directly on the other element or there may also be a centered element. When an element is considered as being "connected" to another element, the element may be directly connected to the other element, or there may be a centered element at the same time. The terms "vertical", "horizontal", "left", "right" and the like used herein are merely for the purpose of description and are not intended to indicate the only embodiment.

Unless otherwise defined, all the technical and scientific terms used herein have the same meaning as commonly understood by those skilled in the art of the invention. Herein, the terms used in the description of the invention are merely for the purpose of describing particular embodiments and are not intended to limit the invention. The term "and/or" used herein includes any and all combinations of one or more of the associated listed items.

Figure 1:
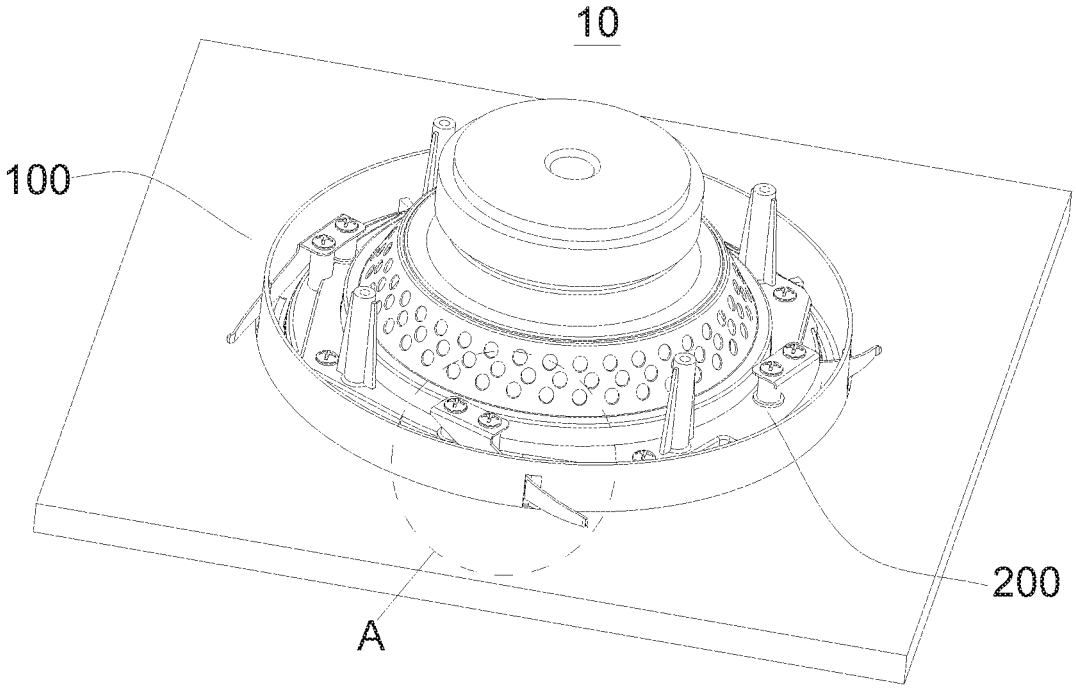
FIG. 1 is a schematic structural view of a rapidly mountable ceiling loudspeaker device in an embodiment of the invention.
Figure 2:
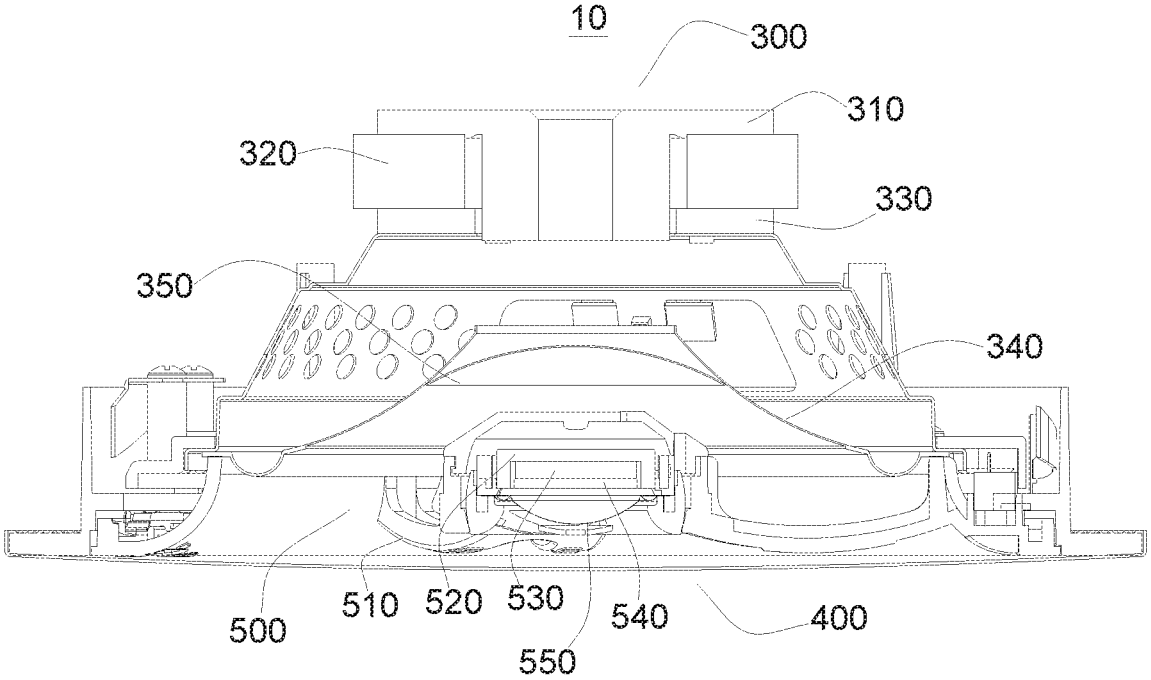
FIG. 2 is a schematic view of an internal structure of a rapidly mountable ceiling loudspeaker device in an embodiment of the invention.

Referring to FIGS. 1 and 2 together, a rapidly mountable ceiling loudspeaker device 10 comprises a loudspeaker housing 100, a ceiling locking assembly 200, a woofer module 300 and a dustproof assembly 400.

Figure 3:
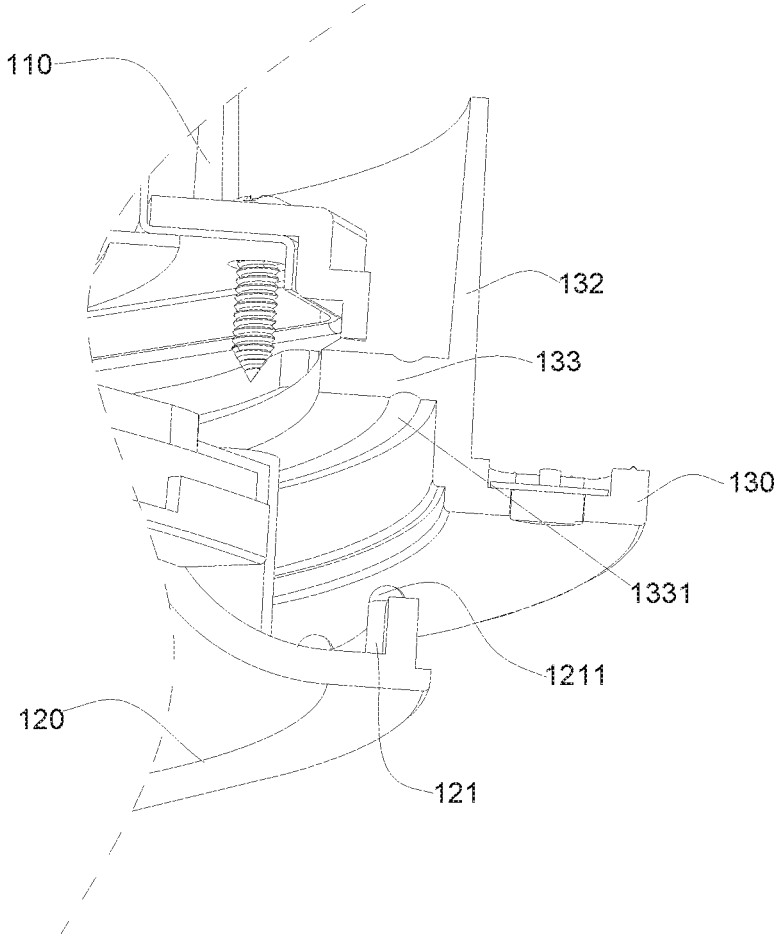
FIG. 3 is a partial schematic structural view of a rapidly mountable ceiling loudspeaker device in an embodiment of the invention.

Referring to FIG. 3, the loudspeaker housing 100 comprises a basket 110, a speaker inner frame 120 and a surface frame ring body 130, wherein the basket 110 is connected with the speaker inner frame 120, the surface frame ring body 130 is arranged between the basket 110 and the speaker inner frame 120, the speaker inner frame 120 can be rotated in the surface frame ring body 130 around the surface frame ring body 130 as a rotation axis, and the surface frame ring body 130 is provided with a via hole 131 and provided with a guide piece at an edge of the via hole 131.

As such, it should be noted that the basket 110, the speaker inner frame 120 and the surface frame ring body 130 function to protect the rapidly mountable ceiling loudspeaker device 10.

Figure 4:
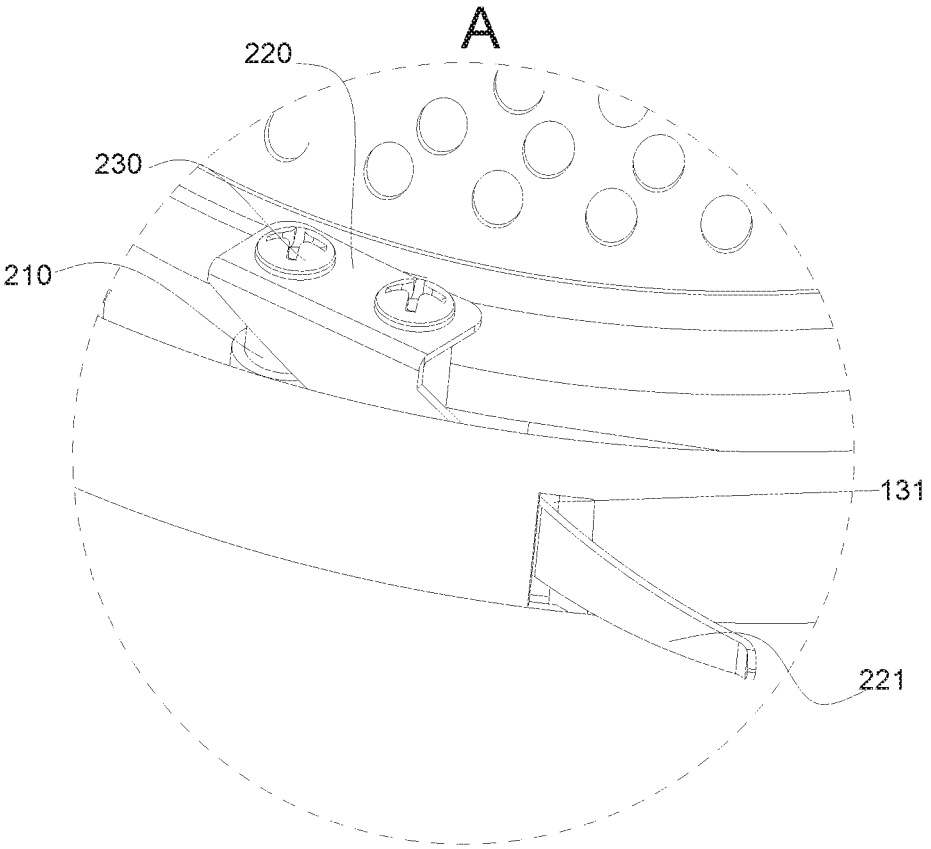
FIG. 4 is an enlarged schematic view of Part A of FIG. 1.

Referring to FIG. 4, the ceiling locking assembly 200 comprises a locking sleeve body 210, a ceiling locking piece 220 and a locking member 230, wherein the locking sleeve body 210 is arranged on the basket 100 and provided with a locking hole, the ceiling locking piece 220 is provided with a through hole, an end of the locking member 230 is passed through the through hole and screwed into the locking hole, the ceiling locking piece 220 is provided with a ceiling locking portion 221, and the ceiling locking portion 221 can move in a direction towards or away from the via hole 131 upon the rotation of the speaker inner frame 120.

As such, it should be noted that, when a user rotates the speaker inner frame 120 clockwise, the ceiling locking portion 221 moves in a direction towards the via hole 131, and after the ceiling locking portion 221 is passed through the via hole, the ceiling locking portion 221 is abutted against the ceiling and the ceiling loudspeaker device 10 is mounted on the ceiling; and when the user rotates the speaker inner frame 120 counterclockwise, the ceiling locking portion 221 moves in a direction away from the via hole 131, and the ceiling locking portion 221 is disengaged from the via hole and no longer abutted against the ceiling to complete the disassembly of the ceiling loudspeaker device 10, thus achieving the rapid mounting and disassembly of the ceiling loudspeaker device 10. The ceiling loudspeaker device can be efficiently assembled and disassembled without the aid of a mounting tool, and the long-term mounting stability of the ceiling loudspeaker device 10 can be ensured, thus preventing the ceiling loudspeaker device from falling from the ceiling and endangering the personal safety of the user.

Referring again to FIG. 2, the woofer module 300 is arranged in the basket 110.

As such, it should be noted that the woofer module 300 is used for bass sounding.

Referring again to FIG. 2, the dustproof assembly 400 is arranged on the speaker inner frame.

As such, it should be noted that the dustproof assembly 400 is used for preventing dust and protecting the woofer module 300.

Further, referring again to FIG. 3, in an embodiment, the speaker inner frame 120 is provided with a limiting column 121, the limiting column 121 is provided with a dome portion 1211, the surface frame ring body 130 comprises a ring wall 132 and a limiting ring body 133, the limiting ring body 133 is arranged on an inner wall of the ring wall 132, the limiting ring body 133 is arranged between the basket 110 and the speaker inner frame 120, the ceiling locking portion 221 is located directly above the limiting ring body 133, the limiting ring body 133 is provided with a sliding groove 1331, the dome portion 1211 is slidably arranged in the sliding groove 1331, and the via hole 131 is located on the ring wall 132.

As such, it should be noted that the limiting column 121 is provided with a dome portion 1211 and the dome portion 1211 is slidably arranged in the sliding groove 1331 so that the user rotates the speaker inner frame 120 more quickly.

Further, referring again to FIG. 3, in an embodiment, the ring wall 133 and the limiting ring body 132 are integrally formed structures.

As such, it should be noted that the design of the ring wall 133 and the limiting ring body 132 as integrally formed structures can improve the overall mechanical strength of the surface frame ring body 130, thus prolonging the service life of the surface frame ring body 130.

Further, referring again to FIG. 2, in an embodiment, the woofer module 300 comprises a bass iron core 310, a bass magnet 320, a bass washer 330, a bass voice coil and a cone paper 340, wherein the bass magnet 320 is arranged on the bass iron core 310, the bass washer 330 is arranged on the bass magnet 320, the basket 110 is connected with the bass washer 330, the bass iron core 310, the bass magnet 320 and the bass washer 330 together enclose a bass magnetic path gap, the bass voice coil is located in the bass magnetic path gap and connected with an inner edge of the cone paper 340, and an outer edge of the cone paper 340 is connected with the basket 110.

As such, it should be noted that when the woofer module 300 starts working, the bass iron core 310, the bass magnet 320 and the bass washer 330 generate a static magnetic field in the bass magnetic path gap when electrified, and the bass voice coil component drives the cone paper 340 to vibrate under the action of the static magnetic field, thus achieving bass sounding.

Further, referring again to FIG X, in an embodiment, the woofer module 300 further comprises a damper, an inner edge of which is connected with the bass voice coil and an outer edge of which is connected with the basket 110.

As such, it should be noted that the damper is used for improving the bass sounding quality of the woofer module 300.

Further, referring again to FIG. 2, in an embodiment, the woofer module 300 further comprises a dust cap 350 which is connected with the inner edge of the cone paper 340.

As such, it should be noted that the dust cap 360 is used for preventing dust and protecting the woofer module 300.

Further, referring again to FIG. 2, in an embodiment, the rapidly mountable ceiling loudspeaker device 10 further comprises a tweeter module 500 which is arranged in the speaker inner frame 120.

As such, it should be noted that the tweeter module 500 is used for treble sounding.

Further, referring again to FIG. 2, in an embodiment, the tweeter module 500 comprises a treble housing 510, a treble iron core 520, a treble magnet 530, a treble washer 540, a treble voice coil and a diaphragm 550, wherein the treble housing 510 is arranged in the speaker inner frame 120, the treble iron core 520 is arranged in the treble housing 510, the treble magnet 530 is arranged on the treble iron core 520, the treble washer 540 is arranged on the treble magnet 530, the treble iron core 510, the treble magnet 530 and the treble washer 540 together enclose a treble magnetic path gap, the treble voice coil is located in the treble magnetic path gap and connected with the diaphragm 550, and an outer edge of the diaphragm 550 is connected with the treble housing 510.

As such, it should be noted that the treble housing 510 provides a protective function; and when the tweeter module 500 starts working, the treble iron core 520, the treble magnet 530 and the treble washer 540 together enclose a treble magnetic path gap which generates a static magnetic field when electrified, and the treble voice coil is allowed to vibrate under the action of the static magnetic field, which further drives the diaphragm 550 to vibrate, thus achieving treble sounding. The rapidly mountable ceiling loudspeaker device 10 is internally provided with the woofer module 300 and the tweeter module 500 so that the rapidly mountable ceiling loudspeaker device 10 has both treble and bass effects, thus greatly improving the loud-speaking effect of the rapidly mountable ceiling loudspeaker device 10.

Specifically, referring again to FIG. 2, in an embodiment, the treble iron core 520 has a "U"-shaped cross section.

Specifically, referring again to FIG. 2, in an embodiment, the treble magnet 530 has a rectangular cross section.

The rapidly mountable ceiling loudspeaker device of the invention is provided with a loudspeaker housing, a ceiling locking assembly, a woofer module and a dustproof assembly. In the practical application process, when a user rotates the speaker inner frame clockwise, the ceiling locking portion moves in a direction towards the via hole, and after the ceiling locking portion is passed through the via hole, the ceiling locking portion is abutted against the ceiling and the ceiling loudspeaker device is mounted on the ceiling; and when the user rotates the speaker inner frame counterclockwise, the ceiling locking portion moves in a direction away from the via hole, and the ceiling locking portion is disengaged from the via hole and no longer abutted against the ceiling to complete the disassembly of the ceiling loudspeaker device, thus achieving the rapid mounting and disassembly of the ceiling loudspeaker device. The ceiling loudspeaker device can be efficiently assembled and disassembled without the aid of a mounting tool, and the long-term mounting stability of the ceiling loudspeaker device can be ensured, thus preventing the ceiling loudspeaker device from falling from the ceiling and endangering the personal safety of the user.

The embodiments described above only express several implementations of the invention, and are described in a relatively specific and detailed manner, but cannot therefore be construed as limiting the patent scope of the invention. It should be noted that the ordinary persons skilled in the art can also make several variations and improvements without departing from the concept of the invention, and all these variations and improvements belong to the protection scope of the invention. Accordingly, the protection scope of the patent of the invention shall be based on the appended claims.

The invention claimed is:

1. A rapidly mountable ceiling loudspeaker device, comprising:

a loudspeaker housing comprising a basket, a speaker inner frame and a surface frame ring body, wherein the basket is connected with the speaker inner frame, the surface frame ring body is arranged between the basket and the speaker inner frame, the speaker inner frame can be rotated in the surface frame ring body around the surface frame ring body as a rotation axis, and the surface frame ring body is provided with a via hole and provided with a guide piece at an edge of the via hole;

a ceiling locking assembly comprising a locking sleeve body, a ceiling locking piece and a locking member, wherein the locking sleeve body is arranged on the basket and provided with a locking hole, the ceiling locking piece is provided with a through hole, an end of the locking member is passed through the through hole and screwed into the locking hole, the ceiling locking piece is provided with a ceiling locking portion, and the ceiling locking portion can move in a direction towards or away from the via hole upon the rotation of the speaker inner frame;

a woofer module arranged in the basket; and a dustproof assembly arranged on the speaker inner frame.

2. The rapidly mountable ceiling loudspeaker device according to claim 1, wherein the speaker inner frame is provided with a limiting column, the limiting column is provided with a dome portion, the surface frame ring body comprises a ring wall and a limiting ring body, the limiting ring body is arranged on an inner wall of the ring wall, the limiting ring body is arranged between the basket and the speaker inner frame, the ceiling locking portion is located directly above the limiting ring body, the limiting ring body is provided with a sliding groove, the dome portion is slidably arranged in the sliding groove, and the via hole is located on the ring wall.

3. The rapidly mountable ceiling loudspeaker device according to claim 2, wherein the ring wall and the limiting ring body are integrally formed structures.

4. The rapidly mountable ceiling loudspeaker device according to claim 1, wherein the woofer module comprises a bass iron core, a bass magnet, a bass washer, a bass voice coil and a cone paper, the bass magnet is arranged on the bass iron core, the bass washer is arranged on the bass magnet, the basket is connected with the bass washer, the bass iron core, the bass magnet and the bass washer together enclose a bass magnetic path gap, the bass voice coil is located in the bass magnetic path gap and connected with an inner edge of the cone paper, and an outer edge of the cone paper is connected with the basket.

5. The rapidly mountable ceiling loudspeaker device according to claim 4, wherein the woofer module further comprises a damper, an inner edge of which is connected with the bass voice coil and an outer edge of which is connected with the basket.

6. The rapidly mountable ceiling loudspeaker device according to claim 4, wherein the woofer module further comprises a dust cap which is connected with the inner edge of the cone paper.

7. The rapidly mountable ceiling loudspeaker device according to claim 1, wherein the rapidly mountable ceiling loudspeaker device further comprises a tweeter module which is arranged in the speaker inner frame.

8. The rapidly mountable ceiling loudspeaker device according to claim 7, wherein the tweeter module comprises a treble housing, a treble iron core, a treble magnet, a treble washer, a treble voice coil and a diaphragm, the treble housing is arranged in the speaker inner frame, the treble iron core is arranged in the treble housing, the treble magnet is arranged on the treble iron core, the treble washer is arranged on the treble magnet, the treble iron core, the treble magnet and the treble washer together enclose a treble magnetic path gap, the treble voice coil is located in the treble magnetic path gap and connected with the diaphragm, and an outer edge of the diaphragm is connected with the treble housing.

9. The rapidly mountable ceiling loudspeaker device according to claim 8, wherein the treble iron core has a "U"-shaped cross section.

10. The rapidly mountable ceiling loudspeaker device according to claim 8, wherein the treble magnet has a rectangular cross section.

* * * * *